US011806592B2

(12) United States Patent
Wada et al.

(10) Patent No.: US 11,806,592 B2
(45) Date of Patent: Nov. 7, 2023

(54) GOLF CLUB HEAD AND METHOD OF MANUFACTURING SAME

(71) Applicant: BRIDGESTONE SPORTS CO., LTD., Tokyo (JP)

(72) Inventors: Kozue Wada, Tokyo (JP); Takaharu Takechi, Tokyo (JP)

(73) Assignee: BRIDGESTONE SPORTS CO., LTD., Tokyo (JP)

( * ) Notice: Subject to any disclaimer, the term of this patent is extended or adjusted under 35 U.S.C. 154(b) by 36 days.

(21) Appl. No.: 17/643,211

(22) Filed: Dec. 8, 2021

(65) Prior Publication Data

US 2022/0193508 A1 Jun. 23, 2022

(30) Foreign Application Priority Data

Dec. 23, 2020 (JP) ..... 2020-214329
Dec. 23, 2020 (JP) ..... 2020-214330
Dec. 23, 2020 (JP) ..... 2020-214331

(51) Int. Cl.
*A63B 53/06* (2015.01)
*A63B 53/04* (2015.01)
*A63B 53/08* (2015.01)

(52) U.S. Cl.
CPC ..... *A63B 53/06* (2013.01); *A63B 53/0412* (2020.08); *A63B 53/0433* (2020.08); *A63B 53/0466* (2013.01); *A63B 53/08* (2013.01); *A63B 2209/00* (2013.01)

(58) Field of Classification Search
CPC .. A63B 53/06; A63B 53/0412; A63B 53/0433
See application file for complete search history.

(56) References Cited

U.S. PATENT DOCUMENTS 1,567,248 A * 12/1925 Dahlman ..... A63B 60/02 473/343
3,659,855 A * 5/1972 Hardesty ..... A63B 60/00 473/342
4,195,842 A * 4/1980 Coleman ..... A63B 53/04 29/415
7,140,977 B2 * 11/2006 Atkins, Sr. ..... A63B 60/00 473/333
7,575,523 B2 * 8/2009 Yokota ..... A63B 53/0466 473/332
8,210,961 B2 * 7/2012 Finn ..... A63B 53/0466 473/345

(Continued)

FOREIGN PATENT DOCUMENTS

JP 2007-167554 7/2007
JP 2007-181616 7/2007

(Continued)

*Primary Examiner* — William M Pierce
(74) *Attorney, Agent, or Firm* — IPUSA, PLLC

(57) ABSTRACT

A golf club head having a hollow structure includes a face, a sole, and a crown. The face includes a front surface and a back surface that face away from each other. The front surface is a ball-striking surface. The sole includes an abutment structure. The abutment structure includes a metallic sole fixation member fixed to the sole, an elastic member, and a metallic pin member connected to the metallic sole fixation member through the elastic member.

7 Claims, 9 Drawing Sheets

(56) References Cited

U.S. PATENT DOCUMENTS

| | | | | |
|---|---|---|---|---|
| 8,608,585 | B2 * | 12/2013 | Stites | A63B 53/047 473/282 |
| 9,901,793 | B2 * | 2/2018 | Ban | A63B 53/047 |
| 10,086,244 | B2 * | 10/2018 | Morin | A63B 53/08 |
| 10,293,226 | B2 * | 5/2019 | Hebreo | A63B 53/08 |
| 10,518,150 | B2 | 12/2019 | Fossum | |
| 10,569,146 | B2 | 2/2020 | Seluga et al. | |
| 10,821,338 | B2 * | 11/2020 | Hebreo | A63B 53/047 |
| 11,020,639 | B2 * | 6/2021 | Golden | A63B 53/047 |
| 11,135,484 | B2 * | 10/2021 | Kitagawa | A63B 53/06 |
| 11,202,946 | B2 * | 12/2021 | Golden | A63B 53/047 |
| 11,338,179 | B2 * | 5/2022 | Takechi | A63B 53/0466 |
| 2005/0272523 | A1 * | 12/2005 | Atkins | A63B 60/00 473/334 |
| 2007/0149316 | A1 | 6/2007 | Nishino | |
| 2007/0161433 | A1 | 7/2007 | Yokota | |
| 2010/0151960 | A1 * | 6/2010 | Wahl | A63B 53/0466 473/347 |
| 2010/0273565 | A1 * | 10/2010 | Stites | A63B 53/047 473/282 |
| 2011/0207552 | A1 * | 8/2011 | Finn | A63B 53/0466 473/346 |
| 2011/0218051 | A1 * | 9/2011 | Stites | A63B 60/00 473/409 |
| 2012/0135822 | A1 * | 5/2012 | Deshmukh | A63B 60/00 473/342 |
| 2013/0324297 | A1 | 12/2013 | Larson | |
| 2015/0360099 | A1 * | 12/2015 | Ban | A63B 53/06 473/324 |
| 2017/0014691 | A1 * | 1/2017 | Takechi | A63B 53/04 |
| 2018/0028883 | A1 | 2/2018 | Morin et al. | |
| 2020/0188743 | A1 | 6/2020 | Kitagawa | |
| 2022/0088450 | A1 * | 3/2022 | Milleman | A63B 60/54 |
| 2022/0184471 | A1 * | 6/2022 | Greaney | A63B 53/0445 |
| 2022/0193508 | A1 * | 6/2022 | Wada | A63B 53/0466 |
| 2022/0379175 | A1 * | 12/2022 | Martens | B29C 66/7212 |
| 2022/0379178 | A1 * | 12/2022 | Parsons | A63B 60/02 |

FOREIGN PATENT DOCUMENTS

| | | |
|---|---|---|
| JP | 2012-525214 | 10/2012 |
| JP | 2015-517882 | 6/2015 |
| JP | 2016-002136 | 1/2016 |
| JP | 2016-158915 | 9/2016 |
| JP | 2017-023216 | 2/2017 |
| JP | 2018-015565 | 2/2018 |
| JP | 2020-092906 | 6/2020 |

* cited by examiner

GOLF CLUB HEAD AND METHOD OF MANUFACTURING SAME

CROSS-REFERENCE TO RELATED APPLICATIONS

This application is based upon and claims priority to Japanese Patent Application Nos. 2020-214329, 2020-214330, and 2020-214331, each filed on Dec. 23, 2020, the entire contents of which are incorporated herein by reference.

BACKGROUND OF THE INVENTION

1. Field of the Invention

The present invention relates to golf club heads and methods of manufacturing the same.

2. Description of the Related Art

Wood-type golf club heads including a face, a sole, and a crown have been known. For such golf club heads, it has been proposed to provide an abutment structure that abuts the back surface of the face at least during impact, in order to, for example, reinforce the face or adjust the stiffness distribution of the face. (See, for example, Japanese Laid-open Patent Publication Nos. 2020-092906, 2016-158915, 2017-023216, and 2018-015565, Japanese Patent Nos. 5542914, 4608437, 4608426, 6363406, and 6093853, and U.S. Pat. Nos. 10,569,146 and 10,518,150).

SUMMARY OF THE INVENTION

According to an aspect of the present invention, a golf club head having a hollow structure includes a face, a sole, and a crown. The face includes a front surface and a back surface that face away from each other. The front surface is a ball-striking surface. The sole includes an abutment structure. The abutment structure includes a metallic sole fixation member fixed to the sole, an elastic member, and a metallic pin member connected to the metallic sole fixation member through the elastic member.

The object and advantages of the invention will be realized and attained by means of the elements and combinations particularly pointed out in the claims.

It is to be understood that both the foregoing general description and the following detailed description are exemplary and explanatory and not restrictive of the invention.

DETAILED DESCRIPTION OF EMBODIMENTS

Figure 1:
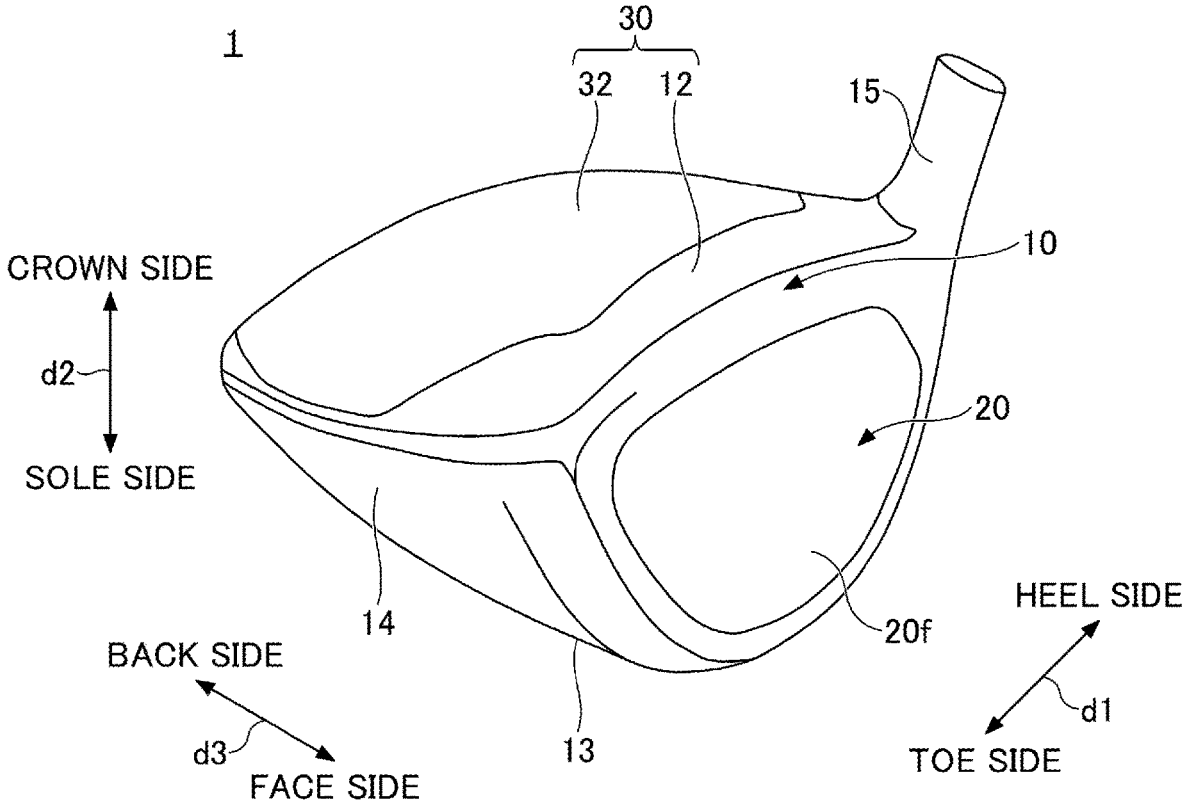
FIG. 1 is a perspective view of a golf club head according to a first embodiment.

According to golf club heads with the abutment structure, every time a golf ball is hit, impact acts on the face to reach the abutment structure that abuts the back surface of the face. Therefore, it is desired to improve the durability of the abutment structure. Furthermore, it is also desired to improve the durability of the face as well as the abutment structure. In addition, according to such golf club heads, it is difficult to adjust the deflection of the face.

According to an aspect of the present invention, a golf club head including a more durable abutment structure is provided.

According to an aspect of the present invention, a golf club head including a more durable abutment structure and body and adjustable in face deflection is provided.

According to an aspect of the present invention, a golf club head including a more durable abutment structure and face is provided.

Embodiments are described below with reference to the accompanying drawings. In the following description, the same components are referred to using the same reference numerals, and a duplicate description thereof may be omitted.

First Embodiment

Figure 2:
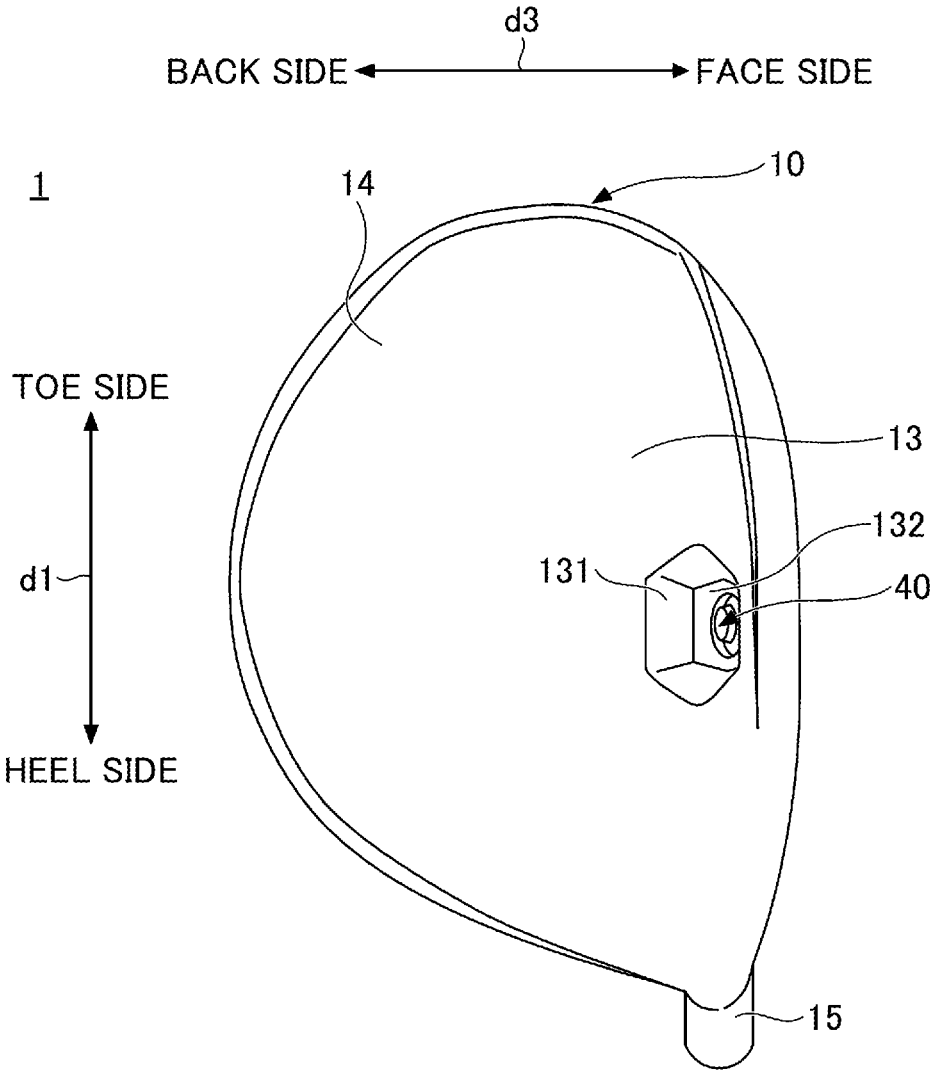
FIG. 2 is a bottom view of the golf club head according to the first embodiment.

FIGS. 1 and 2 are a perspective view and a bottom view, respectively, of a golf club head 1 according to a first embodiment. In FIGS. 1 and 2, the double-headed arrow d1 indicates the toe-heel (left-right) direction, namely, the direction from the toe side to the heel side or the direction from the heel side to the toe side, of the golf club head 1, the double-headed arrow d2 indicates the crown-sole (up-down) direction, namely, the direction from the crown side to the sole side or the direction from the sole side to the crown side, of the golf club head 1, and the double-headed arrow d3 indicates the face-back (front-rear) direction, namely, the direction from the face side to the back side or the direction from the back side to the face side, of the golf club head 1.

The crown-sole direction is a vertical direction when the golf club head 1 is placed in a horizontal plane according to a prescribed lie angle and a prescribed loft angle. The crown-sole direction is substantially perpendicular to the toe-heel direction and the face-back direction. Furthermore, the toe-heel direction is substantially perpendicular to the face-back direction.

The golf club head 1 depicted in FIGS. 1 and 2 is a wood-type golf club head such as a driver head, but may also be a hybrid head or a fairway wood head. The golf club head 1 has a hollow structure into which a body 10, a face 20, and a second crown 32 are joined together and integrated. The inside surface and the outside surface of the hollow structure may be referred to as "inner surface" and "outer surface," respectively.

The body 10 includes a first crown 12, a sole 13, a sidewall 14, and a hosel 15. The first crown 12, together with the second crown 32, defines the top of the golf club head 1. That is, the first crown 12 and the second crown 32 form a crown 30.

The sole 13 defines the bottom of the golf club head 1. The sidewall 14 extends between the crown 30 and the sole 13 to define a curved periphery of the golf club head 1. The hosel 15 accommodates a sleeve connected to a shaft.

The body 10 includes an opening that is open on the face side. The face 20 is joined to the body 10 in such a manner as to close the opening. The face 20 includes a face surface 20*f* (front surface) that defines a ball-striking surface that strikes a golf ball. The face 20 has a predetermined thickness. The face surface 20*f* defines the outer surface of the face 20.

The body 10 includes an opening that is open on the crown side. The second crown 32 is joined to the body 10 in such a manner as to close the opening. As described above, the second crown 32, together with the first crown 12, form the crown 30 that defines the top of the golf club head 1.

The body 10, the face 20, and the second crown 32 may be formed using, for example, titanium, a titanium alloy, stainless steel, aluminum, an aluminum alloy, a ferrous metal, magnesium, a magnesium alloy, or the like. The body 10, the face 20, and the second crown 32 may also be formed using a fiber reinforced resin. The body 10, the face 20, and the second crown 32 may be made of either the same material or different materials.

The fiber-reinforced resin is a composite material of fibers to serve as a reinforcing material and resin. Examples of fibers for the fiber-reinforced resin include carbon fibers, glass fibers, aramid fibers, polyethylene fibers, Zylon®, and boron fibers. Examples of resins for the fiber-reinforced resin include epoxy resins, phenolic resins, polyester resins, and polycarbonate resins.

Figure 3:
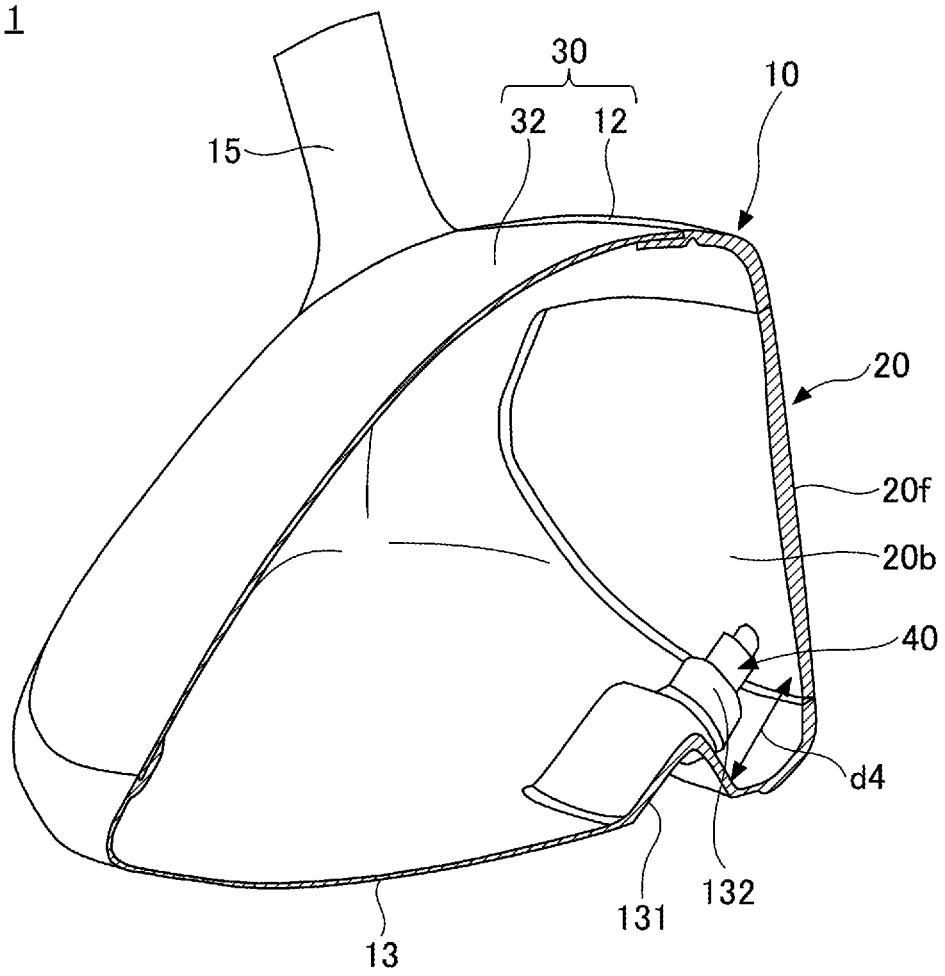
FIG. 3 is a sectional view of the golf club head according to the first embodiment.
Figure 4:
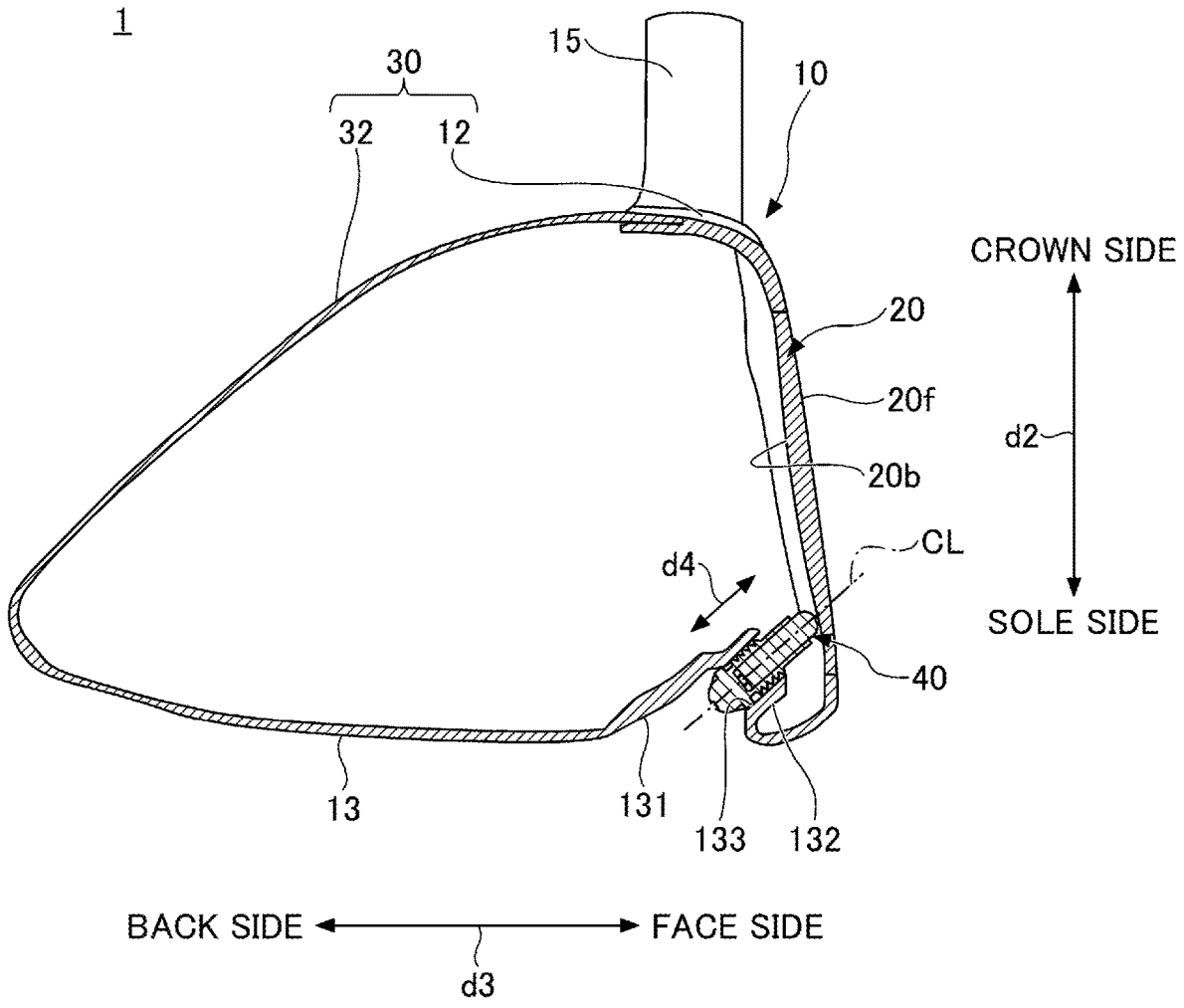
FIG. 4 is a sectional view of the golf club head according to the first embodiment.

FIGS. 3 and 4 are sectional views of the golf club head 1 according to the first embodiment. An abutment structure is described with reference to FIGS. 3 and 4 in addition to FIGS. 1 and 2.

Referring to FIGS. 1 through 4, the sole 13 includes an abutment structure 40 that contacts a back surface 20*b* (inner surface) of the face 20. More specifically, part of the sole 13 is depressed toward the inside of the hollow structure to form a recess 131. A fixing part 132 is formed on a wall portion of the recess 131 on its face 20 side. The fixing part 132 is provided at a position distant from the face 20 in the d3 direction, and fixes the abutment structure 40 to the body 10. In other words, the fixing part 132 is where the abutment structure 40 is attached.

According to this embodiment, the position of the fixing part 132 in the d1 direction is the center, but may also be off the center toward the toe or the heel. Furthermore, according to this embodiment, the position of the fixing part 132 in the d3 direction is on the face 20 side but may also be on the back side relative to the center. The fixing part 132 may alternatively be provided on the sidewall 14 or the crown 30. Furthermore, while one set of the fixing part 132 and the abutment structure 40 is provided according to this embodiment, two or more sets of the fixing part 132 and the abutment structure 40 may be provided at different parts.

The abutment structure 40 is a shaft-shaped member that extends in a d4 direction toward the back surface 20*b* of the face 20. The distal end of the abutment structure 40 contacts the back surface 20*b* of the face 20. The back surface 20*b* is a surface on the opposite side from the face surface 20*f*. A central axis CL of the abutment structure 40 is parallel to the d4 direction. The d4 direction is a direction diagonally upward from the back side toward the face 20 relative to the d3 direction.

Figure 5C:
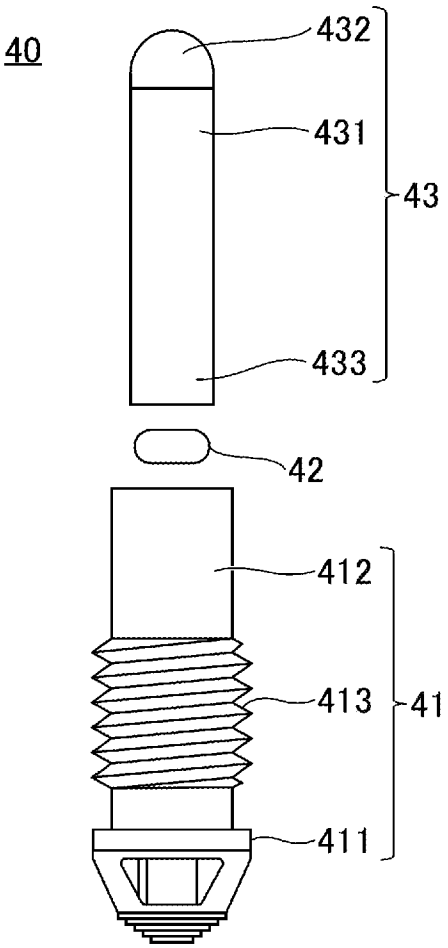
FIGS. 5A through 5C are diagrams illustrating an abutment structure of the golf club head.
Figure 5B:
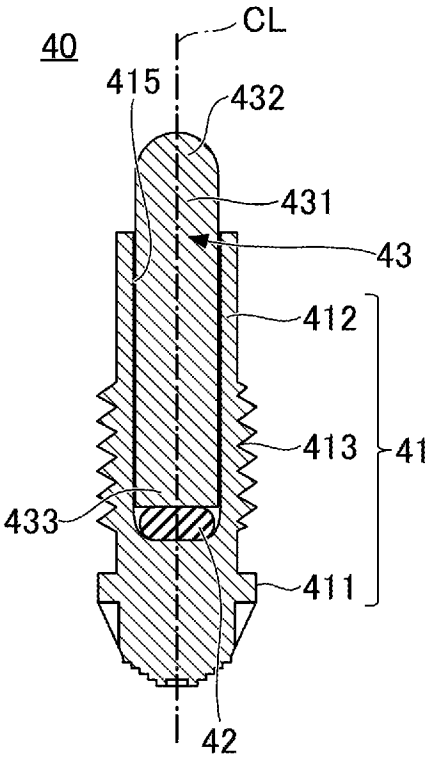
Figure 5A:
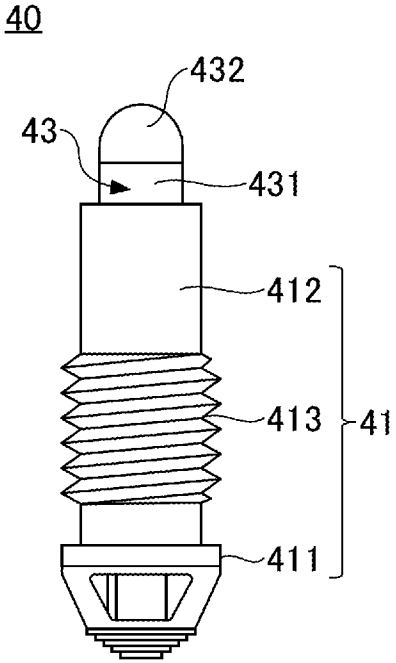

Next, the abutment structure 40 is described with reference to FIGS. 5A through 5C. FIG. 5A is a side view of the abutment structure 40. FIG. 5B is a longitudinal sectional view of the abutment structure 40, taken along a plane including the central axis CL. FIG. 5C is an exploded view of the abutment structure 40. Referring to FIGS. 5A through 5C as well as FIGS. 1 through 4, the abutment structure 40 includes a sole fixation member 41, an elastic member 42, and a pin member 43. According to an aspect of the present invention, examples of elastic members include an elastic body and a viscoelastic body.

The sole fixation member 41 is a stem-shaped component having a one-piece structure and includes a head 411, a tubular body 412, and a thread 413. The sole fixation member 41 is fixed to the sole 13. The tubular body 412 is provided concentrically with the head 411 at one end of the head 411. The thread 413 is provided on part of the outer surface of the tubular body 412 in its longitudinal direction. That is, part of the tubular body 412 in its longitudinal direction is externally threaded to form the thread 413. The tubular body 412 has, for example, a cylindrical shape. The sole fixation member 41 is made of metal such as aluminum, magnesium, titanium, iron, or tungsten.

The central axis of the tubular body 412 coincides with the central axis CL. The tubular body 412 includes a bottomed hole (recess) 415 that is open at one end (on the opposite side from the head 411). The cross section (section taken along a plane perpendicular to the central axis CL) of the recess 415 is, for example, circular. In this case, the central axis CL passes through the center of the circle. The bottom surface of the recess 415 is, for example, substantially at the same position (level) as the head 411 side end of the thread 413 in the direction of the central axis CL. When the tubular body 412 has a cylindrical shape, the outside diameter of the tubular body 412 is, for example, 5 mm or more and 7 mm or less. In this case, the diameter of the recess 415 (the inside diameter of the tubular body 412) is, for example, 3 mm or more and 5 mm or less.

The elastic member 42 has, for example, a disk shape without a hole or groove. The elastic member 42 may also have a shape with a space (hole or groove) on its center side. The elastic member 42 may also have a shape with multiple spaces (holes or grooves) on its center side. The outside diameter of the elastic member 42 is, for example, 2 mm or more and 4 mm or less. The thickness of the elastic member 42 is, for example, 1 mm or more and 4 mm or less. The elastic member 42 is slightly smaller than the recess 415 to be insertable into the recess 415. The material of the elastic member 42 is either a resin composition or a rubber composition. Examples of resin compositions include polyurethane, polyester, and silicone. Examples of rubber compositions include rubber compositions formed of synthetic rubbers such as polybutadiene or natural rubbers.

The elastic member 42 has a simple structure. Therefore, a material having poor formability may be used for the elastic member 42. Furthermore, the elastic member 42 is small and requires less material. Therefore, the elastic member 42 does not unnecessarily increase weight, and an extremely expensive material such as an engineering plastic may also be used for the elastic member 42.

The pin member 43 includes a cylindrical shaft 431 and a distal end portion 432 continuously extends from one end of the shaft 431. The shaft 431 includes a proximal end portion 433 at the other end. The pin member 43 extends toward the back surface 20*b* of the face 20 to have the distal end portion 432 contacting the back surface 20*b* of the face 20. The shaft 431 is slightly smaller than the recess 415 to be insertable into the recess 415. The pin member 43 is made of metal such as aluminum, magnesium, titanium, iron, or tungsten.

The pin member 43 is connected to the sole fixation member 41 via the elastic member 42. Specifically, the elastic member 42 is inserted into the recess 415 (toward the head 411) to its bottom, and the pin member 43 is inserted from its proximal end portion 433 side into the recess 415. In other words, the elastic member 42 is inserted into the recess 415 to contact the bottom surface of the recess 415, and the shaft 431 is inserted into the recess 415, so that the proximal end portion 433, on the opposite side from the distal end portion 432, contacts the elastic member 42. Thus, the elastic member 42 is interposed between the proximal end portion 433 and the bottom of the recess 415. The proximal end portion 433 may be, for example, in surface contact with the elastic member 42. The proximal end portion 433 may be chamfered on its outer edge or surface, for example.

Because the pin member 43 is supported by the recess 415, the pin member 43 can efficiently press the back surface 20*b* of the face 20 without losing force. The shaft 431 is accommodated in the recess 415 for more than or equal to 30% of its length. This prevents the pin member 43 contacting the back surface 20*b* of the face 20 from moving out of place.

The distance from the center of the elastic member 42 in the thickness direction to the tip of the distal end portion 432 of the pin member 43 is longer than the distance from the center of the elastic member 42 in the thickness direction to the open end of the tubular body 412 of the sole fixation member 41. By changing the design of the pin member 43, it is possible to share the sole fixation member 41 among golf club heads varying from driver heads to hybrid heads that differ in abutment distance. Examples of the design items of the pin member 43 include the length and the shape of the shaft 431 and the length and the shape of the distal end portion 432 in the d4 direction.

The cylindrical surface of the shaft 431 may contact the inner side surface of the recess 415, but the shaft 431 is not fixed to the recess 415. That is, the shaft 431 is freely movable within the recess 415 along the longitudinal direction of the recess 415 (along the central axis CL). Even when the shaft 431 is inserted deepest into the recess 415, the distal end portion 432 is exposed outside the sole fixation member 41 on one end side of the sole fixation member 41.

The distal end portion 432 includes a part thinner than the shaft 431. For example, the distal end portion 432 is so shaped as to gradually reduce its cross-sectional area (the area of its section perpendicular to the central axis CL) toward the tip in a direction away from the shaft 431 along the central axis CL. The distal end portion 432 includes a curved surface. The distal end portion 432 has, for example, a hemispherical shape.

The part of the back surface 20*b* contacted by the abutment structure 40 is a lower portion of the face 20, specifically, below the face center. The abutment structure 40 contacts a lower portion (a portion on the sole side 13) of the face 20 to restrict the deformation of the face 20 more in the lower portion than in an upper portion of the face 20. This contributes to an increase in the launch angle of a golf ball when the golf ball is hit.

The face center may be identified as being at a position in the vicinity of the middle between the toe and the heel in the d1 direction on the face surface 20*f* and at a height in the vicinity of the middle between the lowest position and the highest position in the d2 direction on the face surface 20*f* when the sole 13 contacts the ground at a prescribed lie angle and a prescribed loft angle. Here, letting an end in the toe-heel direction be 0% and letting the other end in the toe-heel direction be 100%, the "vicinity of the middle" in the d1 direction is defined as a zone of 45% or more and 55% or less. Furthermore, letting an end in the crown-sole direction be 0% and letting the other end in the crown-sole direction be 100%, the "vicinity of the middle" in the d2 direction is defined as a zone of 45% or more and 55% or less.

According to this embodiment, the fixation structure of the fixing part 132 and the sole fixation member 41 is a screw (thread) structure, and a screw (threaded) hole 133 is formed in the d4 direction in the fixing part 132. For example, a hexagonal groove is provided in the head 411 of the sole fixation member 41. By inserting the tip of a hex wrench or the like into the groove of the head 411 and turning the sole fixation member 41, the thread 413 of the sole fixation member 41 can mate with the screw hole 133.

According to the abutment structure 40, a position at which the sole fixation member 41 is fixed (the fixation position of the sole fixation member 41) may be adjusted in the direction from the fixing part 132 to the face 20 (the d4 direction). That is, the fixation position of the sole fixation member 41 relative to the fixing part 132 changes along the d4 direction according to the amount of screwing of the thread 413 into the screw hole 133. This makes it possible to adjust the length of extension (the amount of projection) of the sole fixation member 41 toward the face 20 relative to the end face of the fixing part 132 on the face 20 side. That is, it is possible to adjust the position of the distal end portion 432 in the d4 direction. As a result, it is possible to adjust the deflection of the face 20.

Even when there is an individual difference in each of the abutment structure 40 and the fixing part 132, it is possible to ensure that the distal end portion 432 of the abutment structure 40 contacts the back surface 20*b* of the face 20 by adjusting the amount of screwing of the thread 413 into the screw hole 133. According to the abutment structure 40, the fixation position of the sole fixation member 41 that maximizes the length of extension from (relative to) the fixing part 132 is where the head 411 of the sole fixation member 41 contacts the back-side end face of the fixing part 132.

The fixation structure of the fixing part 132 and the sole fixation member 41, however, is not limited to a screw structure, and may be a fixation structure employing another method such as press-fitting, bonding, welding or bucking.

Next, the adjustment of the deflection of the face 20 is described.

According to the golf club head 1, the deflection of the face 20 may be adjusted by changing the tightening torque of the sole fixation member 41 of the abutment structure 40 with respect to the fixing part 132 of the sole 13. For example, an increase in the tightening torque of the sole fixation member 41 with respect to the fixing part 132 restricts the deflection of the face 20 to decrease the amount of deflection of the face 20.

Figure 6:
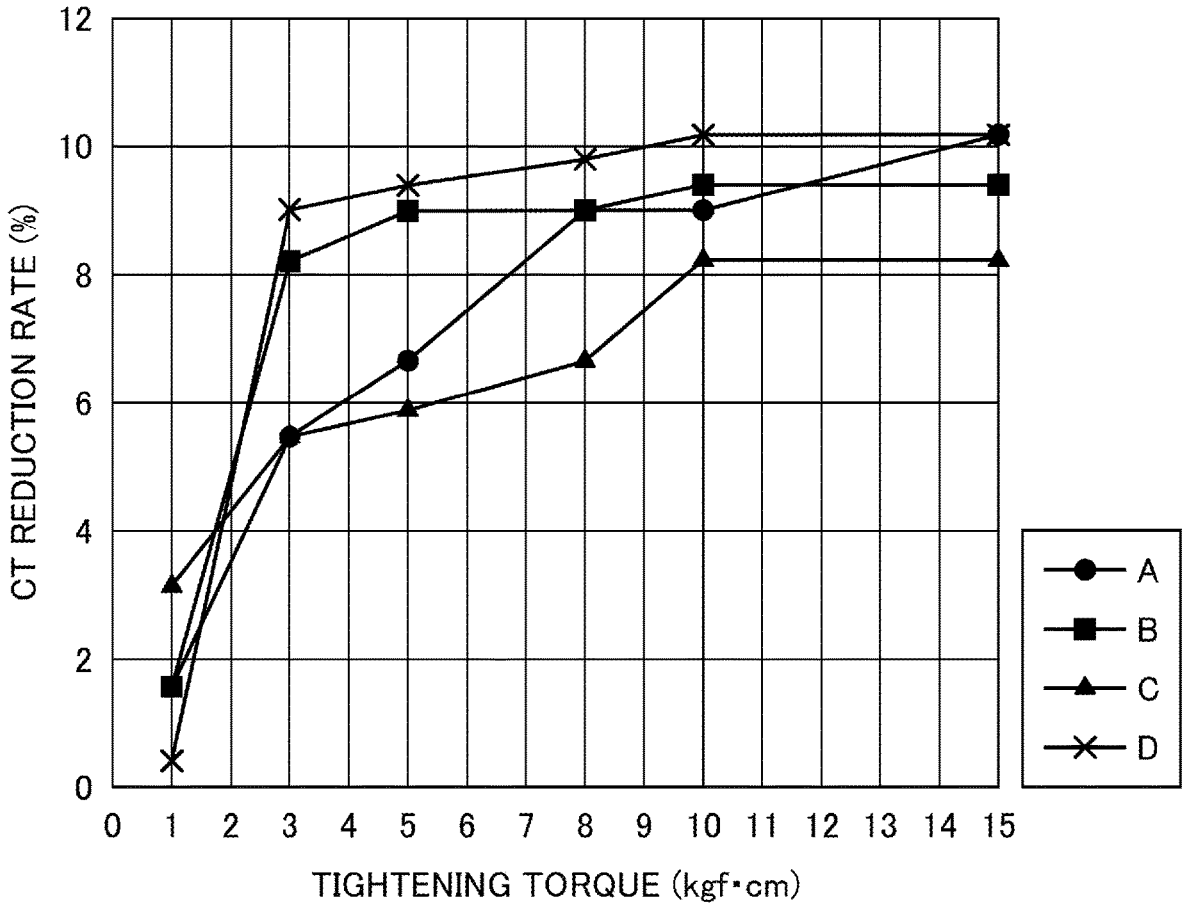
FIG. 6 is a graph illustrating the relationship between the tightening torque of a sole fixation member with respect to a fixing part and the deflection of a face.

FIG. 6 is a graph illustrating the relationship between the tightening torque of the sole fixation member 41 with respect to the fixing part 132 and the deflection of the face 20. In FIG. 6, the tightening torque is on the horizontal axis and the CT (characteristic time) reduction rate is on the vertical axis. The CT reduction rate is a value calculated (expressed) as a percentage of a CT value in the case where the abutment structure 40 is out of contact with the back surface 20*b* of the face 20 (namely, the deflection of the face 20 is totally unrestricted). The CT value is a value that indicates the coefficient of restitution (COR) of the face.

In FIGS. 6, A, B, C and D indicate materials for the elastic member 42, where A is silicone, B is polyurethane (a), C is polyurethane (b), and D is polyester. FIG. 6 shows that the deflection of the face 20 can be adjusted by changing the tightening torque of the sole fixation member 41 with respect to the fixing part 132. This adjustment is possible because the compressed state of the elastic member 42 changes as the tightening torque changes.

FIG. 6 also shows that the relationship between the tightening torque of the sole fixation member 41 with respect to the fixing part 132 and the deflection of the face 20 differs between materials for the elastic member 42. This is because how easily the elastic member 42 is compressed as the tightening torque is varied differs between materials for the elastic member 42. For example, using polyurethane (a) of B or polyester of D as the material of the elastic member 42 makes it possible to adjust the face deflection within the range of approximately 0% to approximately 10% by changing the tightening torque between 1 kgf·cm and 3 kgf·cm.

The upper limit of the CT value is determined by the SLE (spring-like effect) rule set by the Royal and Ancient Golf Club of St Andrews. Golf club heads having a CT value close to the upper limit of the SLE rule are advantageous in improving flight distance performance because of high face repulsion. The manufacture of golf club heads, however, always entails manufacturing error. Therefore, it is difficult to approximate the CT values of all golf club heads to the upper limit of the SLE rule without making any adjustments.

According to the golf club head 1, however, the deflection of the face 20, namely, the CT value of the face 20, may be adjusted by changing the tightening torque of the sole fixation member 41 with respect to the fixing part 132. Thus, for example, the golf club head 1 may be designed such that the face 20 has a distribution of CT values slightly higher than a regulation value (the upper limit of the SLE rule), and the CT values may be adjusted to be at or below the regulation value by adjusting the tightening torque during the manufacturing process of the golf club head 1. In this manner, it is possible to manufacture the golf club head 1 whose CT value does not exceed and is close to the upper limit of the SLE rule.

The CT value measurement may be performed on all manufactured golf club heads 1. Alternatively, a random measurement may be performed on a predetermined number of golf club heads 1 with respect to each manufacturing lot, and when a manufacturing lot in which the CT value varies on the high side is identified, a full measurement may be performed on the identified manufacturing lot. The CT value may be measured, for example, using a dedicated measuring instrument compliant with the Pendulum Test.

Next, a method of manufacturing the golf club head 1 according to the first embodiment is described.

Figure 7:
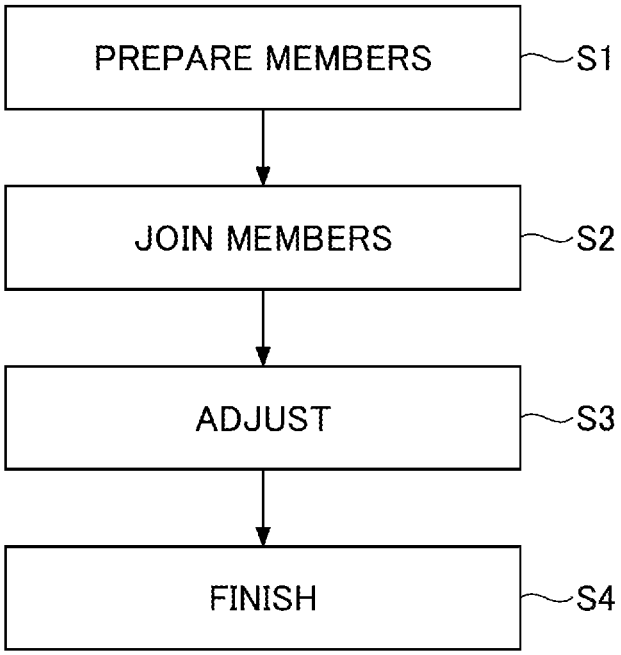
FIG. 7 is a flowchart illustrating a process of manufacturing the golf club head.

FIG. 7 is a flowchart of a process of manufacturing the golf club head 1. Referring to FIG. 7, at step S1, individual members, specifically, the body 10, the face 20, the second crown 32, and the abutment structure 40, are prepared. These members may be made by, for example, casting, forging, press molding, 3D printing, or another forming method. At this stage, a bulge and a roll are formed on the face 20. A structure including the fixing part 132 is formed on the body 10.

Next, at step S2, the body 10, the face 20, and the second crown 32 are joined to form a hollow structure. The joining may be performed by an appropriate method such as bonding or welding. The vicinities of the joints are ground to smooth the unevenness of the joints on an as-needed basis. For example, grinding equipment such as a grinder may be used for grinding.

Next, at step S3, the abutment structure 40 is attached to the fixing part 132 of the sole 13 of the hollow structure, and the deflection of the face 20 is adjusted. Specifically, the deflection of the face 20 is adjusted by changing the tightening torque of the sole fixation member 41 of the abutment structure 40 with respect to the fixing part 132 of the sole 13 from outside the hollow structure.

As illustrated in FIG. 6, the relationship between the tightening torque of the sole fixation member 41 with respect to the fixing part 132 and the deflection of the face 20 is known in advance. Therefore, the CT value of the hollow structure may be measured, and the deflection of the face 20 is adjusted by changing the tightening torque such that the CT value approximates to the upper limit of the SLE rule without exceeding the upper limit of the SLE rule.

For example, in the case of using polyurethane (a) of B illustrated in FIG. 6 as the material of the elastic member 42, the CT value is measured at a tightening torque of 2 kgf·cm. Then, by changing the tightening torque based on the measurement result, the CT value is adjusted by approximately 0% to approximately 10%. Thereby, the CT value can be a value close to the upper limit of the SLE rule without exceeding the upper limit of the SLE rule. At step S3, if the adjustment of the deflection of the face 20 is unnecessary, the adjustment may be omitted.

Next, at step S4, finishing including pattern forming, painting, etc., is performed on an as-needed basis. For example, a pattern may be formed on the surface (outer surface) of the hollow structure by emitting a laser beam onto the surface from a laser processing machine. To apply paint on the surface of the hollow structure, surface preparation such as primer treatment or ion plating is preferably performed on the surface. Various painting methods such as brush painting, spray painting, and electrostatic painting are employable. By the above-described process, the golf club head 1 is completed.

Thus, according to the golf club head 1, the distal end portion 432 of the abutment structure 40 contacts the back surface 20*b* of the face 20 to restrict the deformation of part of the face 20 that contacts the distal end portion 432. That is, the abutment structure 40 serves as a reinforcing member that locally restricts the deformation of the face 20. According to the abutment structure 40, the distal end portion 432 is tapered to make point contact with the back surface 20*b* of the face 20. This makes it possible to prevent the deformation of the face 20 from being excessively restricted.

The distal end portion 432 of the abutment structure 40 may contact the back surface 20*b* of the face 20 to the extent that the back surface 20*b* of the face 20 in a natural state is not pressed or is pressed toward the face surface 20*f*. Furthermore, the degree of pressing may be adjustable by the degree of fastening of the thread 413 of the sole fixation member 41 to the screw hole 133 of the fixing part 132. Moreover, in the case where the fastening of the thread 413 of the sole fixation member 41 to the screw hole 133 of the fixing part 132 is maximized, the distal end portion 432 of the abutment structure 40 may slightly displace the back surface 20*b* of the face 20 toward the face surface 20*f*.

As a result of the restriction of the deformation of part of the face 20 that contacts the distal end portion 432 of the abutment structure 40, the stiffness distribution of the face 20 becomes such that the stiffness is lower above the center and is higher below the center. That is, the face 20 is more likely to deflect toward the back in its upper portion at impact. Therefore, it is possible to increase the launch angle of a golf ball when the golf ball is hit.

Furthermore, the weight of the abutment structure 40 relatively shifts the position of the center of gravity of the golf club head 1 toward the face 20. Accordingly, the amount of backspin on a hit golf ball tends to be reduced. This results in a higher maximum flight distance performance of a hit golf ball.

The central axis CL of the abutment structure 40 is not parallel to but crosses the normal direction of the back surface 20*b*. Because the abutment structure 40 diagonally contacts the back surface 20*b* of the face 20, it is possible to prevent more stress than is necessary from concentrating on the abutment structure 40, the fixing part 132, or part of the face 20 contacted by the abutment structure 40 at impact.

Furthermore, the distal end portion 432 is, for example, hemispherical in shape, and part of the curved surface of the hemisphere contacts the back surface 20*b* of the face 20. Because the distal end portion 432 contacts the back surface 20*b* of the face 20 on its curved surface, the abutment structure 40 can contact the back surface 20*b* in a more uniform manner irrespective of the individual difference of the abutment structure 40. Furthermore, because the distal end portion 432 contacts the back surface 20*b* of the face 20 on its curved surface, it is possible to prevent the abutment structure 40 from unnecessarily restricting the deformation of the face 20 at impact.

Furthermore, according to the golf club head 1, the elastic member 42 is interposed between the metallic sole fixation member 41 and the metallic pin member 43, which are constituent parts of the abutment structure 40. According to this structure, by selecting the material of the elastic member 42, the tightening torque of the sole fixation member 41 with respect to the fixing part 132 and the deflection of the face 20 present a certain relationship. Therefore, by changing the tightening torque, it is possible to adjust the deflection of the face 20.

Furthermore, according to the abutment structure 40, because the pin member 43 including the distal end portion 432 is made of metal, it is possible to improve the durability (breakage resistance) of the pin member 43, compared with a structure whose distal end portion is an elastic body.

Furthermore, in the case of assuming that the abutment structure 40 is constituted entirely of metallic parts, a constituent part of the abutment structure 40 and the body 10 may be broken because of an impact at impact because a force received from the face 20 has nowhere to go. In contrast, according to the golf club head 1, the elastic member 42 is interposed between the metallic sole fixation member 41 and the metallic pin member 43, which are constituent parts of the abutment structure 40. Therefore, when the abutment structure 40 receives a force from the face 20, the elastic member 42 deforms. This makes it possible to release a force from the face 20, and it is therefore possible to prevent the breakage of the metallic sole fixation member 41 and the metallic pin member 43 due to an impact at impact. That is, it is possible to provide the golf club head 1 including the abutment structure 40 and the body 10 with improved durability (breakage resistance).

In terms of further improving the durability of the metallic sole fixation member 41 and the metallic pin member 43, the Young's modulus of the sole fixation member 41 is preferably 60 GPa or more, and more preferably, 90 GPa or more. Furthermore, the Young's modulus of the pin member 43, which directly receives a force from the face 20, is preferably 90 GPa or more.

Examples of materials for the sole fixation member 41 and the pin member 43 are as described above. Examples of suitable materials for the sole fixation member 41 and the pin member 43 that can improve the durability include titanium and titanium-based materials (such as titanium alloys) having a Young's modulus of 90 GPa or more. In the case of focusing on weight reduction, aluminum and aluminum-based materials (such as aluminum alloys) having a Young's modulus of 60 GPa or more are usable for the sole fixation member 41, and titanium and titanium-based materials (such as titanium alloys) having a Young's modulus of 90 GPa or more are usable for the pin member 43. While titanium has a relative density of approximately 4.5, aluminum has a relative density of approximately 2.7.

In order to ensure that a force that the abutment structure 40 receives from the face 20 is sufficiently released, the elastic member 42 preferably has a smaller width than the recess 415 in a sectional view of the abutment structure 40 taken along a plane including the central axis CL (namely, in the state of FIG. 5B). This makes it possible to create a space that allows the elastic member 42 to sufficiently deform outward when the abutment structure 40 receives a force from the face 20, thus making it possible to further improve the durability of the abutment structure 40.

For example, in a sectional view of the abutment structure 40 taken along a plane including the central axis CL, when the width of the recess 415 (the distance between opposing points on the inner side surface of the recess 415) is 4 mm, the width of the elastic member 42 may be 3 mm. In this case, the interval between the side surface of the elastic member 42 and the inner side surface of the recess 415 is 0.5 mm in the sectional view, so that it is possible to create a space that allows the elastic member 42 to sufficiently deform outward.

Furthermore, the elastic member 42 may include a space on its center side instead of or in addition to being smaller in width than the recess 415. In this case, when the abutment structure 40 receives a force from the face 20, the elastic member 42 can deform toward the central axis CL to release the force from the face 20.

Furthermore, according to the abutment structure 40, because the pin member 43 including the distal end portion 432 is made of metal, it is possible to improve a capability to suppress the repulsion of the face 20 compared with a structure whose distal end portion is an elastic body. That is, according to the abutment structure 40, it is possible to improve a capability to suppress the CT value that indicates the COR of the face 20.

Furthermore, by improving the capability to suppress the repulsion of the face 20, it is possible to reduce the thickness of the face 20. In general, reduction in the thickness of a face increases the repulsion of the face, so that the CT value is highly likely to exceed the upper limit of the SLE rule, namely, 257 μs. Therefore, it is difficult to reduce the thickness of the face. In contrast, according to the golf club head 1, the pin member 43, which is a constituent part of the abutment structure 40, is made of metal to improve the capability to suppress the repulsion of the face 20. Therefore, it is possible to cause the CT value to fall within the range of the above-described rule even when the face 20 is reduced in thickness. As a result, the golf club head 1 as a whole can be reduced in weight.

Furthermore, according to the golf club head 1, the distal end portion 432 of the abutment structure 40 contacts the back surface 20*b* of the face 20 to restrict the deformation of part of the face 20 that contacts the distal end portion 432. As a result, it is possible to intentionally reduce the repulsion of the face 20. Therefore, it is possible to achieve design that provides high repulsion without exceeding the upper limit of the rule over a wider area.

Figure 8A:
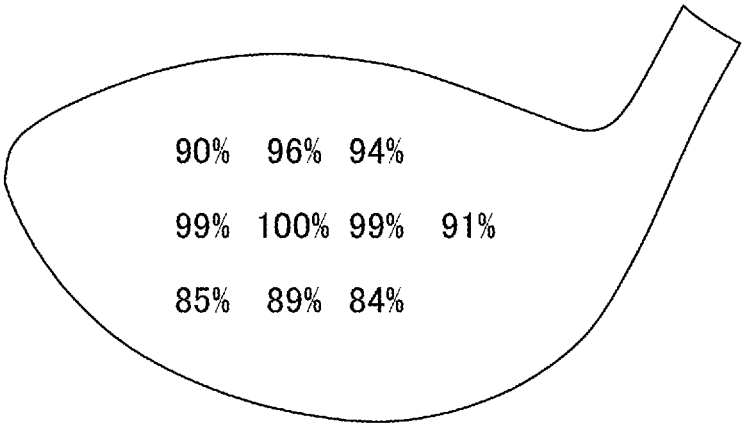
FIGS. 8A and 8B are diagrams illustrating a difference in the repulsion distribution of the face.
Figure 8B:
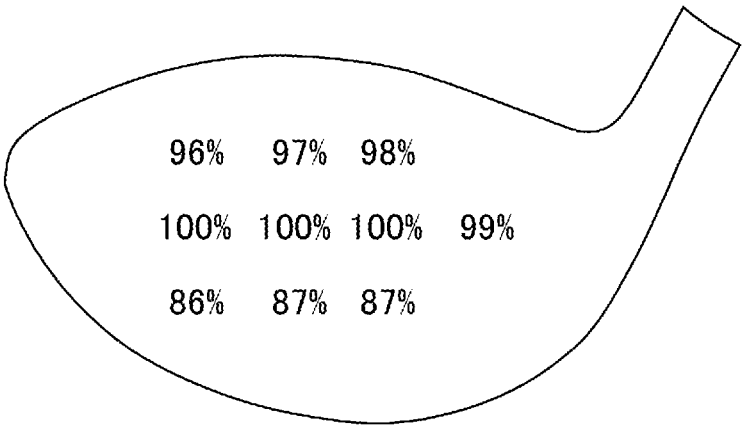

For example, FIGS. 8A and 8B illustrate repulsion distributions in which 100% indicates where the repulsion is highest. FIG. 8A is an example of the actually measured data of a golf club head with no abutment structure. FIG. 8B is an example of the actually measured data of the golf club head 1 including the abutment structure 40.

FIGS. 8A and 8B show that the golf club head 1 including the abutment structure 40 has a larger high repulsion area than the golf club head with no abutment structure. That is, compared with the golf club head with no abutment structure, the golf club head 1 is improved in repulsion in an off-center portion. While the weight of the face of the golf club head illustrated in FIG. 8A is 34 g, the weight of the face 20 of the golf club head 1 illustrated in FIG. 8B is reduced to 31 g.

Second Embodiment

Next, a second embodiment is described. The second embodiment is different from the first embodiment in that the distal end portion 432 of the abutment structure 40 is opposite (faces) the back surface 20*b* of the face 20 without contacting the back surface 20*b*. Otherwise, the golf club head 1 of the second embodiment may be the same as the golf club head 1 of the first embodiment.

Figure 9:
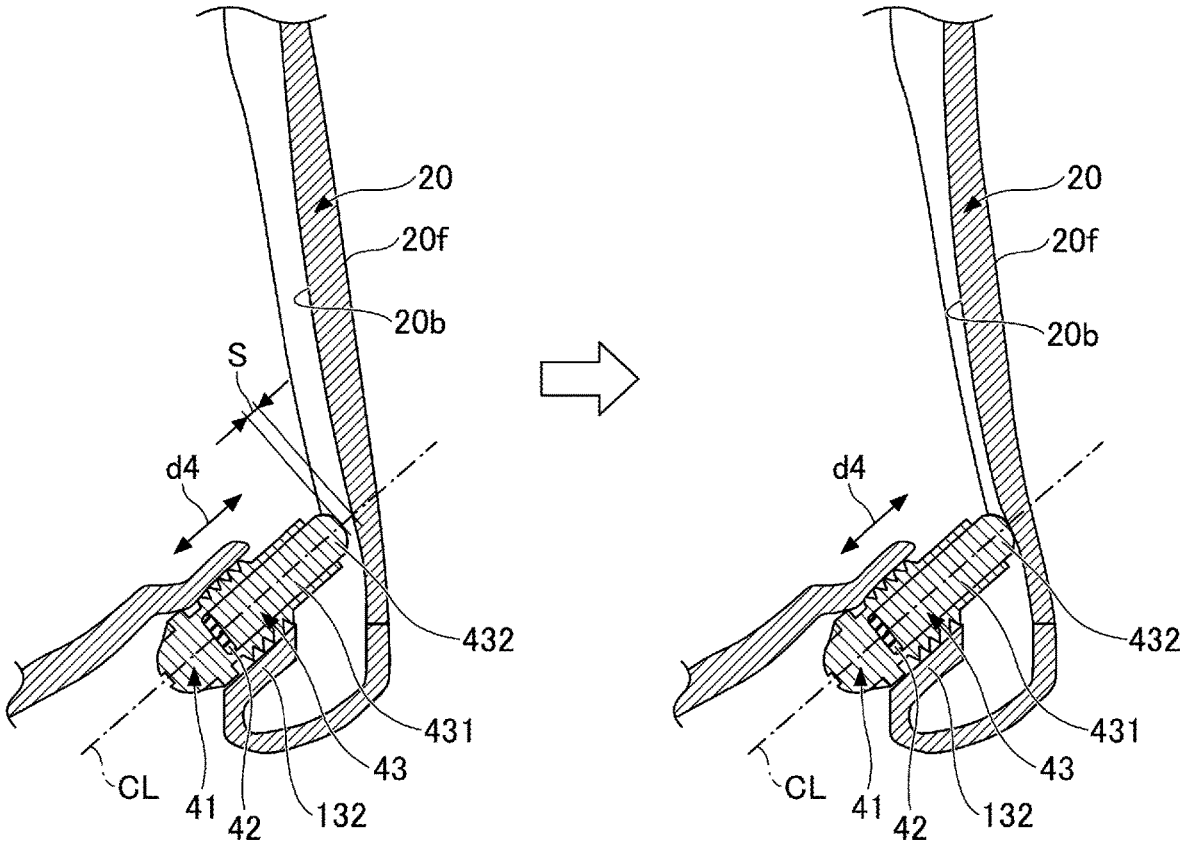
FIG. 9 is a diagram illustrating the gap between the abutment structure and a back surface of the face according to a second embodiment.

FIG. 9 is a diagram illustrating the gap between the abutment structure 40 and the back surface 20*b* of the face 20 according to the second embodiment. FIG. 9 illustrates a state where no golf ball is hit with the face surface 20*f* (when there is no impact) on the left side of the arrow, and illustrates a state at the moment of hitting a golf ball with the face surface 20*f* (at impact) on the right side of the arrow. As illustrated on the left side of the arrow in FIG. 9, when no golf ball is hit with the face surface 20*f*, a gap S is created between the distal end portion 432 of the pin member 43 of the abutment structure 40 and the back surface 20*b* of the face 20. The gap S is 0.1 mm or more and 2 mm or less.

In contrast, as illustrated on the right side of the arrow in FIG. 9, in a state at the moment of striking a golf ball with the face surface 20*f*, the distal end portion 432 of the pin member 43 of the abutment structure 40 is in contact with the back surface 20*b* of the face 20. Normally, the deflection of the face 20 at impact is approximately 2 mm. Therefore, by setting the gap S to 0.1 mm or more and 2 mm or less, it is possible to cause the distal end portion 432 of the pin member 43 to contact the back surface 20*b* of the face 20 at impact.

The design, however, does not have to be such that the distal end portion 432 of the pin member 43 always contacts the back surface 20*b* of the face 20 at every impact. For example, the design may be such that the distal end portion 432 of the pin member 43 contacts the back surface 20*b* of the face 20 only when the face 20 significantly deflects in response to a strong hit. Conversely, the gap S may be set to 0.1 mm or more and 1 mm or less so that the distal end portion 432 of the pin member 43 is more likely to contact the back surface 20*b* of the face 20 at impact.

Part of the back surface 20*b* that is positioned on a line extended from the abutment structure 40 in the d4 direction is a lower portion of the face 20, specifically, below the face center. That is, the pin member 43 of the abutment structure 40 extends toward an area below the face center of the back surface 20*b* of the face 20. The abutment structure 40 contacts a lower portion (a portion on the sole side 13) of the face 20 at impact to support the lower portion of the face 20.

The same as in the first embodiment, according to the abutment structure 40, the fixation position of the sole fixation member 41 may be adjusted in the direction from the fixing part 132 to the face 20 (the d4 direction). As a result, it is possible to adjust the value of the gap S between the distal end portion 432 of the pin member 43 and the back surface 20*b* of the face 20.

Even when there is an individual difference in each of the abutment structure 40 and the fixing part 132, it is possible to adjust the value of the gap S between the distal end portion 432 of the pin member 43 and the back surface 20*b* of the face 20 by adjusting the amount of screwing of the thread 413 into the screw hole 133. According to the abutment structure 40, the fixation position of the sole fixation member 41 that maximizes the length of extension from (relative to) the fixing part 132 is where the head 411 of the sole fixation member 41 contacts the back-side end face of the fixing part 132. [Impact Durability Test]

TABLE 1

| | CT Value [μs] | Impact Durability Test Result |
|---|---|---|
| Comparative Example | 240 | Cracked after 2507 impacts. |
| Example 1 | 220 | No cracking up to 4000 impacts. |
| Example 2 | 240 | No cracking up to 4000 impacts. |

Table 1 shows the results of an impact durability test conducted by the inventors, etc., to check the presence or absence of face cracking, using a dedicated apparatus for repeatedly impacting a golf club head at a constant strength. This dedicated apparatus repeatedly causes a golf ball to collide with the stationary face at a constant speed from a constant distance. Table 1 also shows CT value measurement results. The maximum number of impacts was 4000, and the test was not continued beyond the maximum number. This is because a golf club head without cracks after 4000 impacts is considered as durable enough to be marketable.

In Table 1, Comparative Example indicates the test result of a golf club head with no abutment structure, Example 1 indicates the test result of the golf club head 1 of the first embodiment, in which the abutment structure 40 constantly (when there is no impact and at impact) contacts the back surface 20*b* of the face 20, and Example 2 indicates the test result of the golf club head 1 of the second embodiment, in which there is the gap S between the abutment structure 40 and the back surface 20*b* of the face 20. That is, according to Example 2, the gas S is created between the distal end portion 432 of the pin member 43 and the back surface 20*b* of the face 20 when there is no impact, and the distal end portion 432 contacts the back surface 20*b* of the face 20 only at impact.

The golf club heads of Comparative Example, Example 1, and Example 2 were equal in face material and thickness. The ball speed of the dedicated apparatus at impact was constant at 55 m/s.

As illustrated in Table 1, the CT value of the golf club head of Comparative Example was 240 μs, and the face cracked after 2507 impacts. In contrast, the CT value of the golf club head 1 of Example 1 was 220 μs, and the face did not crack even after 4000 impacts. Furthermore, the CT value of the golf club head 1 of Example 2 was 240 μs, and the face did not crack even after 4000 impacts.

These results show that the golf club head with no abutment structure is significantly less durable with respect to repeated impacts than the golf club head 1 including the abutment structure 40. Furthermore, the abutment structure 40 contacts the back surface 20*b* of the face 20 at least at impact to significantly improve the durability with respect to repeated impacts, so that no cracking occurs even after 4000 impacts.

Furthermore, compared with the golf club head 1 of the first embodiment, in which the abutment structure 40 constantly (when there is no impact and at impact) contacts and holds the back surface 20*b* of the face 20, the golf club head 1 of the second embodiment is less restricted in face deformation to have a higher CT value, thus being advantageous in flight distance performance. The structure of Example 2 makes it possible to ensure a higher CT value and improved durability with respect to repeated impacts.

Next, a method of manufacturing the golf club head 1 according to the second embodiment is described.

The method of the second embodiment is different from the method of the first embodiment in the process of step S3 of FIG. 7. Otherwise, the method of the second embodiment may be the same as the method of the first embodiment.

At step S3, the abutment structure 40 is attached to the fixing part 132 of the sole 13 of the hollow structure, and the value of the gap S between the distal end portion 432 of the pin member 43 and the back surface 20*b* of the face 20 is adjusted. Specifically, a gap of 0.1 mm or more and 2 mm or less is provided between the pin member 43 and the back surface 20*b* of the face 20 by changing the tightening torque of the sole fixation member 41 of the abutment structure 40 with respect to the fixing part 132 of the sole 13 from outside the hollow structure.

For example, the correspondence between the tightening torque and the gap S is obtained in advance. This makes it possible to adjust the gap S by adjusting the tightening torque to within a predetermined range. For example, the tightening torque is preferably varied within the range of greater than zero and less than or equal to 1 kgf·cm, and more preferably, varied within the range of greater than zero and less than or equal to 0.5 kgf·cm. This makes it possible to adjust the gap S to within a predetermined range of 0.1 mm or more and 2 mm or less. After the adjustment of the gap S, the sole fixation member 41 of the abutment structure 40 may be bonded to the fixing part 132 of the sole 13 to prevent a change in the adjusted value.

Thus, according to the golf club head 1 of the second embodiment, the abutment structure 40 supports the face 20 at impact. Therefore, it is possible to reduce a load on the face 20 at impact. This improves the durability of the face 20 to prevent the breakage of the face 20. Furthermore, the improved durability of the face 20 makes it possible to reduce the thickness of the face 20.

Furthermore, the gap S is created between the distal end portion 432 of the pin member 43 and the back surface 20*b* of the face 20 when there is no impact, and the distal end portion 432 contacts the back surface 20*b* of the face 20 only at impact. Therefore, the abutment structure 40 is prevented from holding the face 20 with excessive strength at impact. As a result, the face 20 can improve durability with respect to repeated impacts while maintaining a high CT value.

Specifically, when the golf club head 1 is a fairway wood head, relatively inexpensive stainless steel is often used as the material of the face 20 for reasons such as two or more fairway woods often being a setup. Stainless steel, however, is not very durable. Therefore, causing the distal end portion 432 to contact the back surface 20*b* of the face 20 only at impact is very advantageous in improving the durability of the face 20. The volume of the head of the fairway wood is approximately 150 cc or more and approximately 230 cc or less.

Furthermore, the central axis CL of the abutment structure 40 is not parallel to but crosses the normal direction of the back surface 20*b*. Because the abutment structure 40 diagonally contacts the back surface 20*b* of the face 20 at impact, it is possible to prevent more stress than is necessary from concentrating on the abutment structure 40, the fixing part 132, or part of the face 20 contacted by the abutment structure 40 during impact.

Furthermore, the distal end portion 432 is, for example, hemispherical in shape, and part of the curved surface of the hemisphere contacts the back surface 20*b* of the face 20 at impact. Because the distal end portion 432 contacts the back surface 20*b* of the face 20 on its curved surface, the abutment structure 40 can contact the back surface 20*b* in a more uniform manner irrespective of the individual difference of the abutment structure 40. Furthermore, because the distal end portion 432 contacts the back surface 20*b* of the face 20 on its curved surface, it is possible to prevent the abutment structure 40 from unnecessarily restricting the deformation of the face 20 at impact. It is particularly preferable that the contact between the distal end portion 432 and the back surface 20*b* of the face 20 be close to point contact.

Furthermore, the gap S is created between the distal end portion 432 of the pin member 43 and the back surface 20*b* of the face 20 when there is no impact, and the distal end portion 432 contacts the back surface 20*b* of the face 20 only at impact. Therefore, the elastic member 42 is not deformed when there is no impact. This makes it possible to maximize the elasticity of the elastic member 42 at impact.

Furthermore, the same as in the first embodiment, because the pin member 43 is supported by the recess 415, the pin member 43 can efficiently press the back surface 20*b* of the face 20 without losing force. The shaft 431 is accommodated in the recess 415 for more than or equal to 30% of its length. This prevents the pin member 43 extending toward the back surface 20*b* of the face 20 from moving out of place.

All examples and conditional language provided herein are intended for pedagogical purposes of aiding the reader in understanding the invention and the concepts contributed by the inventors to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that various changes, substitutions, and alterations could be made hereto without departing from the spirit and scope of the invention.

What is claimed is:

1. A golf club head having a hollow structure, the golf club head comprising:

a crown that defines a top of the golf club head;

a sole that defines a bottom of the golf club head, the sole including an abutment structure; and a face including a front surface and a back surface facing away from each other, wherein the crown, the sole and the face surround the hollow structure, a first recess is formed in the sole toward an inside of the hollow structure, a fixing part is formed in the first recess, the fixing part being configured to fix the abutment structure, the abutment structure includes a metallic sole fixation member fixed to the sole, a metallic pin member connected to the metallic sole fixation member, and an elastic member interposed between the metallic sole fixation member and the metallic pin member, the metallic pin member includes a shaft and a distal end portion, the distal end portion extending from a first end of the shaft and including a part thinner than the shaft, the metallic sole fixation member includes a second recess that is open at an end of the metallic sole fixation member, the elastic member is inserted in the second recess and in contact with a bottom surface of the second recess, the shaft is inserted in the second recess, and a second end of the shaft opposite from the first end is in contact with the elastic member, and the distal end portion is exposed outside the metallic sole fixation member on a side of the end of the metallic sole fixation member.

2. The golf club head as claimed in claim 1, wherein the shaft is accommodated in the second recess for 30% or more of a length of the shaft.

3. The golf club head as claimed in claim 1, wherein the shaft is freely movable within the second recess along a longitudinal direction of the second recess.

4. The golf club head as claimed in claim 1, wherein a width of the elastic member is smaller than a width of the second recess in a sectional view taken along a plane including a central axis of the second recess.

5. The golf club head as claimed in claim 1, wherein the elastic member includes a space on a center side thereof.

6. The golf club head as claimed in claim 1, wherein a material of the elastic member is a resin composition or a rubber composition.

7. The golf club head as claimed in claim 1, wherein the abutment structure is a shaft-shaped member that extends in a direction toward the back surface of the face, and a distal end of the abutment structure contacts the back surface of the face.

* * * * *